United States Patent [19]

Richter et al.

[11] Patent Number: 5,025,854

[45] Date of Patent: Jun. 25, 1991

[54] APPARATUS FOR INSPECTION AND/OR REPAIR OF TUBES DISCHARGING INTO A CHAMBER OF A HEAT EXCHANGER

[75] Inventors: Bernd Richter, Uelzen; Helmar Adams, Erlangen, both of Fed. Rep. of Germany

[73] Assignee: Siemens Aktiengesellschaft, Munich, Fed. Rep. of Germany

[21] Appl. No.: 247,075

[22] Filed: Sep. 20, 1988

[30] Foreign Application Priority Data

Sep. 22, 1987 [DE] Fed. Rep. of Germany ... 8712772[U]

[51] Int. Cl.[5] ..... F28G 13/00; F28G 15/00; B25J 3/00; B25J 15/04

[52] U.S. Cl. ..... 165/11.2; 165/76; 901/1; 901/44; 376/245; 376/260; 29/723; 29/727

[58] Field of Search ..... 165/11.2, 76; 901/1, 901/44; 376/245, 260; 29/723, 727

[56] References Cited

U.S. PATENT DOCUMENTS

| | | | |
|---|---|---|---|
| 3,766,005 | 10/1973 | Erkens | 376/245 |
| 3,954,136 | 5/1976 | Gugel | 165/76 |
| 4,004,698 | 1/1977 | Gebelin | 165/76 |
| 4,172,492 | 10/1979 | Abell et al. | 165/11.2 |
| 4,188,167 | 2/1980 | Abell | 165/76 |
| 4,222,699 | 9/1980 | Dunn et al. | 165/76 |
| 4,298,054 | 11/1981 | Adamowski | 376/245 |
| 4,373,855 | 2/1983 | Lebouc | 165/76 |
| 4,521,150 | 6/1985 | Pigeon et al. | 165/76 |
| 4,581,198 | 4/1986 | Kamei et al. | 376/245 |
| 4,585,203 | 4/1986 | Monne et al. | 165/11.2 |
| 4,757,258 | 7/1988 | Kelly, Jr. et al. | 165/11.2 |
| 4,784,561 | 11/1988 | Cartry et al. | 165/11.2 |

FOREIGN PATENT DOCUMENTS

| | | | |
|---|---|---|---|
| 0090725 | 10/1983 | European Pat. Off. | 165/11.2 |
| 0152778 | 8/1985 | European Pat. Off. . | |
| 2552341 | 6/1976 | Fed. Rep. of Germany . | |
| 3430384 | 2/1986 | Fed. Rep. of Germany . | |
| 2211721 | 7/1974 | France . | |
| 0017675 | 6/1976 | Japan | 376/245 |

*Primary Examiner*—John Ford

*Attorney, Agent, or Firm*—Herbert L. Lerner; Laurence A. Greenberg

[57] ABSTRACT

An apparatus for the inspection and/or repair of tubes discharging into a chamber of a heat exchanger includes a tube sensor. A manipulator provides remote-controlled positioning of the tube sensor. A plurality of mouthpieces disposed on the manipulator introduces the sensor into tubes of a heat exchanger. Tube connectors communicate with the mouthpieces and have two ends. One of the ends of the tube connectors is coaxially attachable to orifices of the tubes of the heat exchanger. The other of the ends of the tube connectors are bundled into a circular group at an adaptor. A distributor plate has orifices into each of which a respective one of the tube connectors discharge. A parallel turntable is supported on the distributor plate. A guide hose is introduced into the turntable for guiding the tube sensor. Incremental rotation of the turntable selectively aligns the axis of the guide hose with the axis of one of the orifices in the distributor plate.

6 Claims, 4 Drawing Sheets

Figures 1, 1A, 1B:
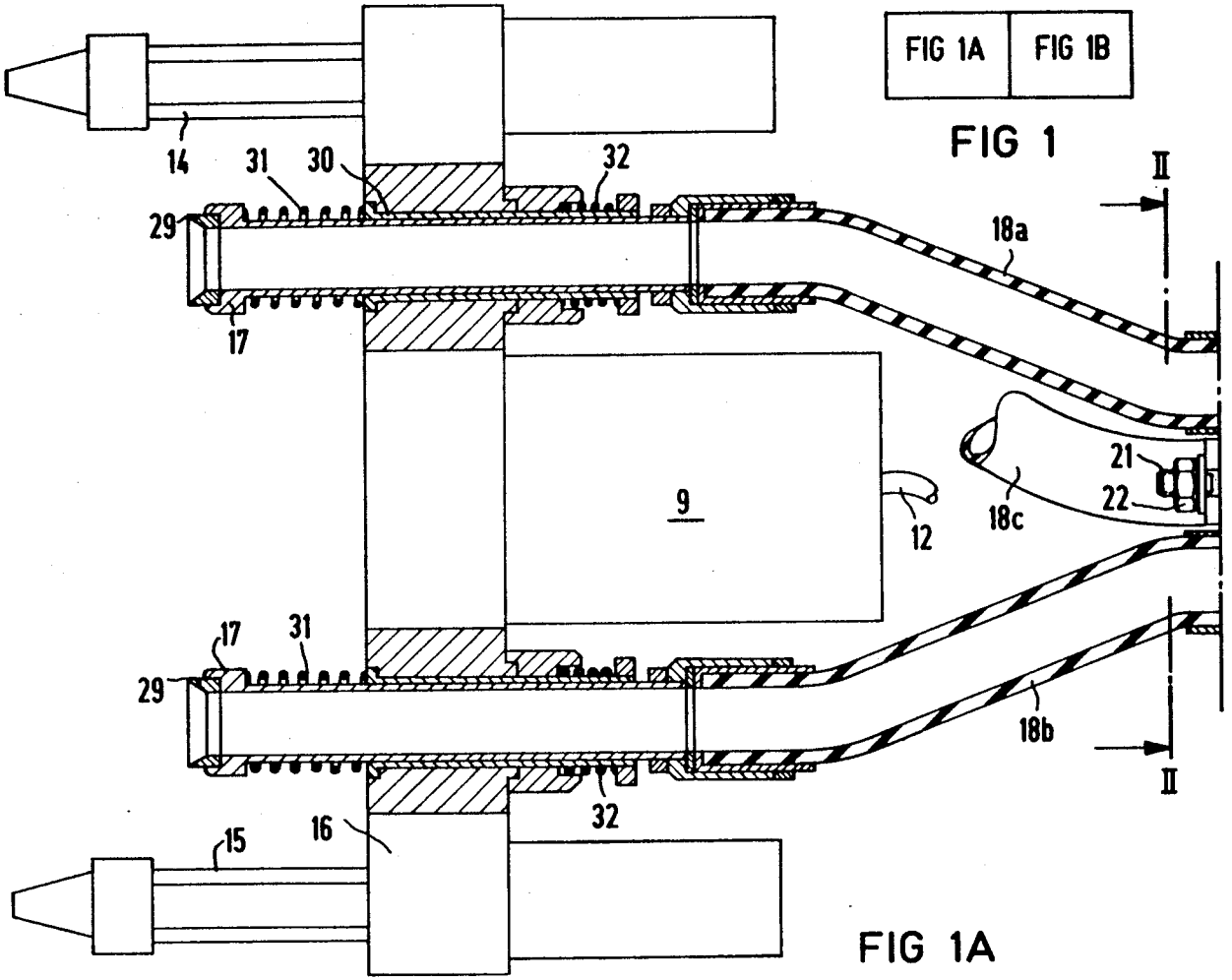
Figure 1B:
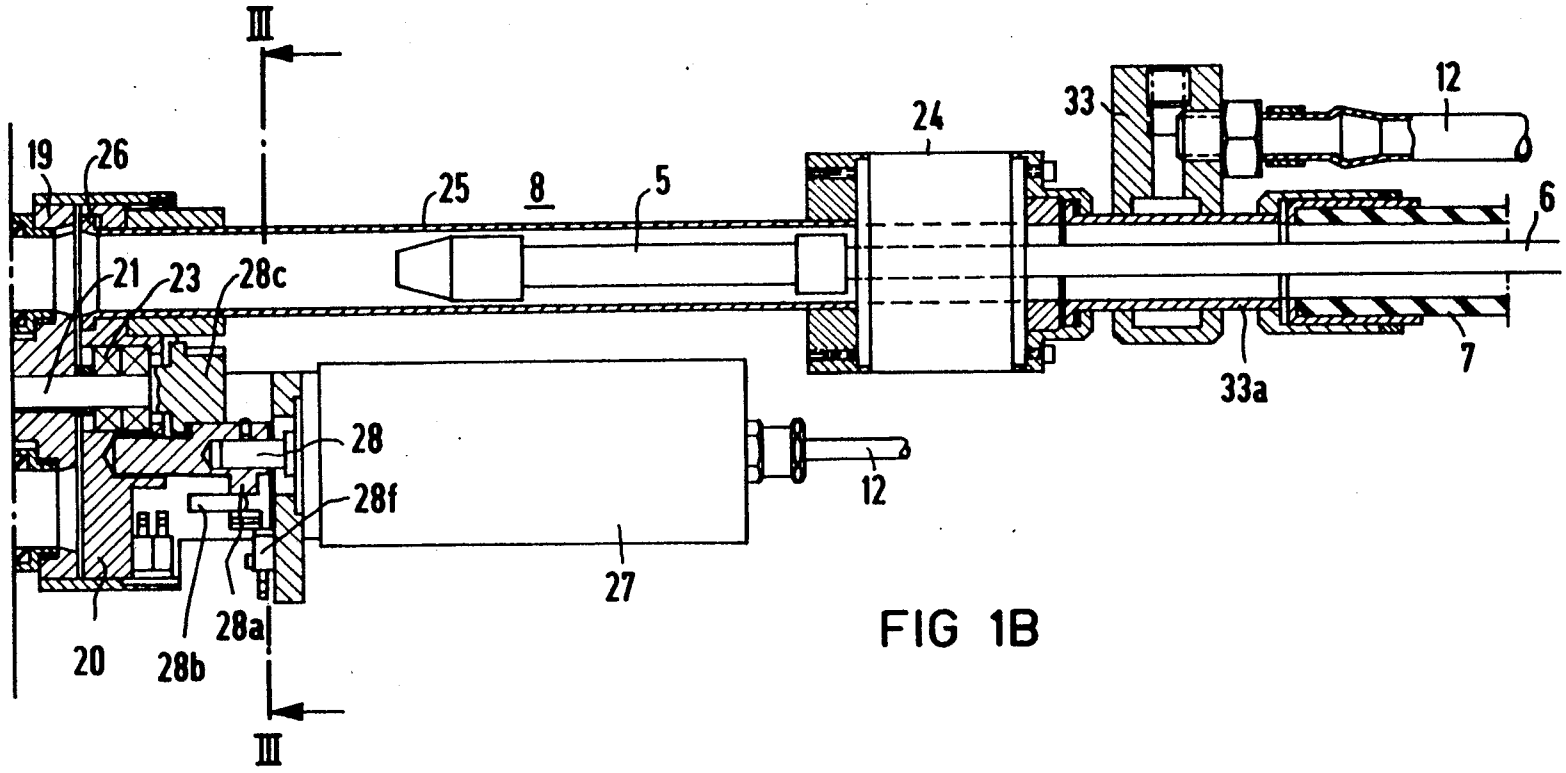

II
II
18a
18b
18c
21
22
12
9
32
32
30
31
31
17
17
29
29
14
15
16

APPARATUS FOR INSPECTION AND/OR REPAIR OF TUBES DISCHARGING INTO A CHAMBER OF A HEAT EXCHANGER

The invention relates to an apparatus for the inspection and/or repair of tubes discharging into a chamber of a heat exchanger and can be used to position a tube sensor by remote control. Heat exchanger tubes that are disposed inside a boiler of a heat exchanger for nuclear power plants must be inspected at specified time intervals, in order to ascertain any possible damage or sediment. For this purpose, eddy flow sensors are typically introduced from a heat exchanger chamber into which the ends of the heat exchanger tubes discharge through a tube sheet. Devices that are disposed in the chamber of the heat exchanger are used for positioning the sensors. German Published, Non-Prosecuted Application DE-OS 34 30 384, corresponding to U.S. Pat. No. 4,645,581, discloses a device for cleaning (electropolishing) the inner surface of heat exchanger tubes, in which a sensor in the form of an electrode can be inserted into a heat exchanger tube and retracted once again through a pulling device. Two manipulators are used for the remote-controlled positioning of the tube sensor in the orifices of the heat exchanger tubes. Each manipulator is provided with spreading mandrels that can be anchored in heat exchanger tubes and with an adaptor having a hose connection for the tube sensor. Each hose connection can be pressed through a seal against the orifice of a heat exchanger tube. Through remote control of the manipulator, the adaptors can be positioned with respect to the desired individual heat exchanger tubes in such a way that the hose connections are pressed precisely in alignment with the orifices of a desired heat exchanger tube and the sensor, which is in the form of an electrode, can be introduced from a location outside the heat exchanger by remote control through the hose. In other words, the sensor need not be threaded into the individual heat exchanger tubes on site, so that members of the operating staff do not have to remain in the area which is exposed to radiation.

German Published, Non-Prosecuted Application DE-OS 25 52 341 discloses a device for positioning a tube sensor by means of a manipulator, which has spreading mandrels that can be anchored in heat exchanger tubes. The manipulator is substantially formed of two parts that are movable relative to one another and slide along one another, each part having its own spreading mandrels which are used to lock the entire manipulator at the tube field One part moves away with the spreading mandrels released and after it has executed its incremental movement, and after its locking mandrels are locked once again, the other part of the manipulator can execute its incremental movement. This manipulator not only has means for controlling the distancing movement for the incrementing mechanism, but it also has a local control for the two movable parts, each of which has two or three mouthpieces for elastic guide tubes of the tube sensor. The manipulator can be displaced in a given direction by the spacing distance between any two tubes, so that in each case one or the other of the guide tubes coincides with a desired heat exchanger tube. The guide tubes are joined with the other connecting lines into an elastic group of tubes and are extended to the outside through a manhole to supply equipment, where the tube sensor is also selectively inserted into one of the guide tubes.

In these known apparatus for remote-controlled inspection and/or repair of heat exchanger tubes, shifting the sensor from one guide hose into the other takes considerable time.

It is accordingly an object of the invention to provide an apparatus for inspection and/or repair of tubes discharging into a chamber of a heat exchanger, which overcomes the hereinafore-mentioned disadvantages of the heretofore-known devices of this general type, which enables simplification of the manipulation and control of the sensor and which permits shortening of the time required to move a sensor from one tube to the next.

With the foregoing and other objects in view there is provided, in accordance with the invention, an apparatus for the inspection and/or repair of tubes discharging into a chamber of a heat exchanger, comprising a tube sensor, a manipulator for the remote-controlled positioning of the tube sensor, a plurality of mouthpieces disposed on the manipulator for introducing the sensor into tubes of a heat exchanger, tube connectors communicating with the mouthpieces and having two ends, one of the ends of the tube connectors being coaxially attachable to orifices of the tubes of the heat exchanger, an adaptor at which the other of the ends of the tube connectors are bundled into a circular group, a distributor plate having orifices into each of which a respective one of the tube connectors discharge, a parallel turntable supported on the distributor plate, a guide hose introduced into the turntable for guiding the tube sensor, and means for incrementally rotating the turntable for selectively aligning the axis of the guide hose with the axis of one of the orifices in the distributor plate.

In this way, the manipulator only needs to be positioned once for testing or repairing a larger number of heat exchanger tubes, and heavy parts of the manipulator need not be moved in order to sweep over a plurality of tube orifices. As a result, energy can be saved, and the time for centering the manipulator or for repeatedly aligning a mouthpiece for the tube sensor can be shortened. A lowpower drive is sufficient for the incremental drive of the turntable. Moreover, the test schedule can be arranged as desired regardless of the various positioning regions of the mouthpieces.

In accordance with another feature of the invention, the adaptor is disposed in the vicinity of the manipulator. As a result, only a single guide tube needs to be extended to the outside from the chamber, so that the weight of the drag cable of the manipulator is reduced considerably.

In accordance with a further feature of the invention, the rotating means include a drive motor and a Maltese cross incremental motion linkage connected between the Maltese cross incremental motion linkage and the turntable.

In accordance with an added feature of the invention, there is provided a ring sensor through which the guide hose communicates with the adaptor.

In accordance with an additional feature of the invention, there is provided a supply cable, and an intermediate adaptor element connected between the supply cable and the guide hose for delivering medium into the guide hose, the intermediate adaptor element being disposed upstream of the adaptor as seen in direction of medium flow.

In accordance with a concomitant feature of the invention, there are provided sheaths releasably retained on the manipulator, the mouthpieces being displaceably supported in the sheaths, and springs holding the mouthpieces in a given position.

Other features which are considered as characteristic for the invention are set forth in the appended claims.

Although the invention is illustrated and described herein as embodied in an apparatus for inspection and/or repair of tubes discharging into a chamber of a heat exchanger, it is nevertheless not intended to be limited to the details shown, since various modifications and structural changes may be made therein without departing from the spirit of the invention and within the scope and range of equivalents of the claims.

Figure 2:
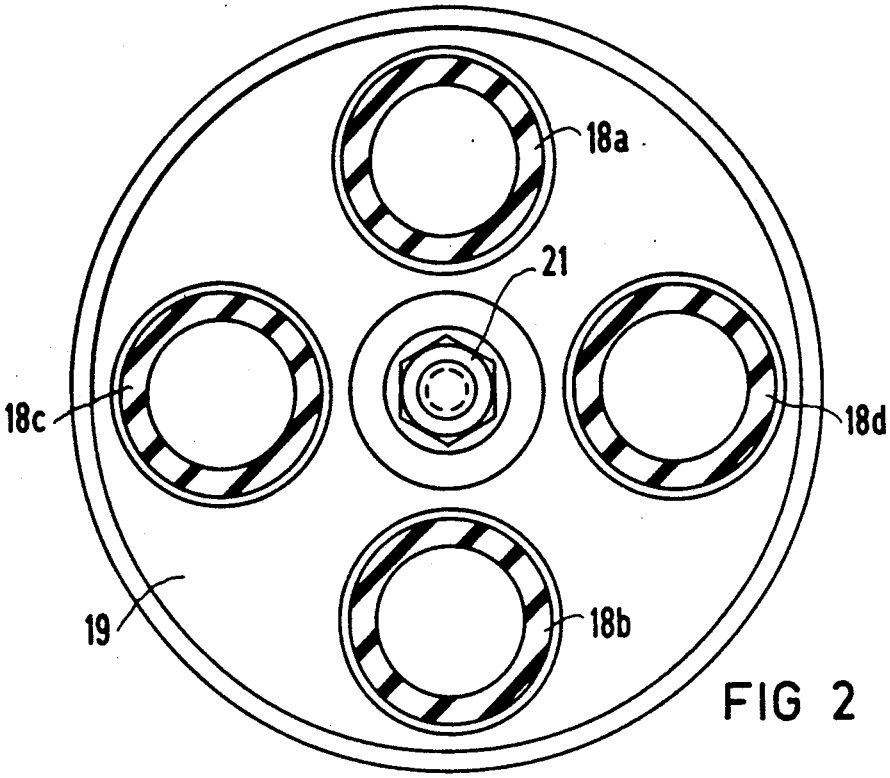
Figure 3:
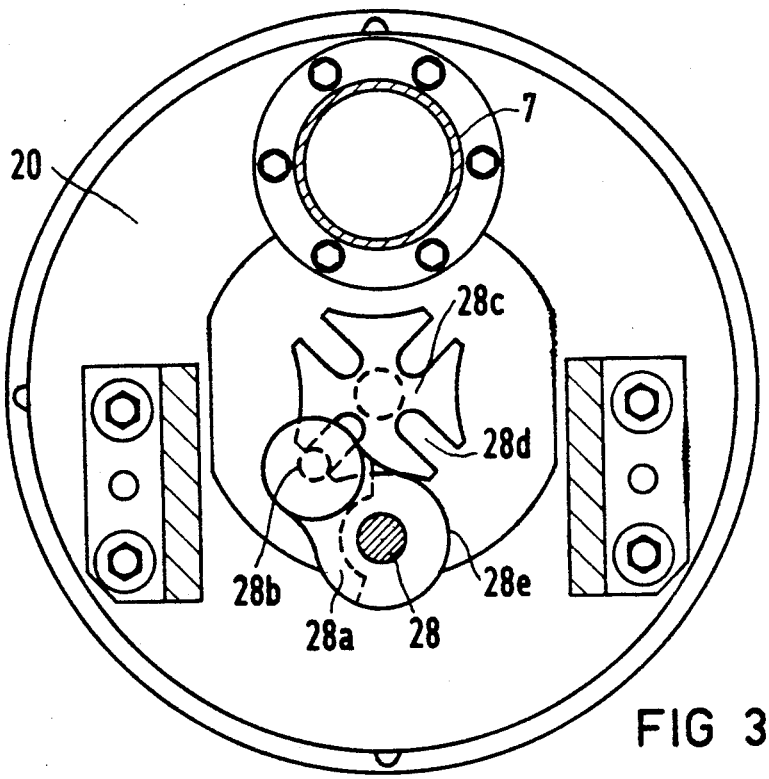
Figure 4:
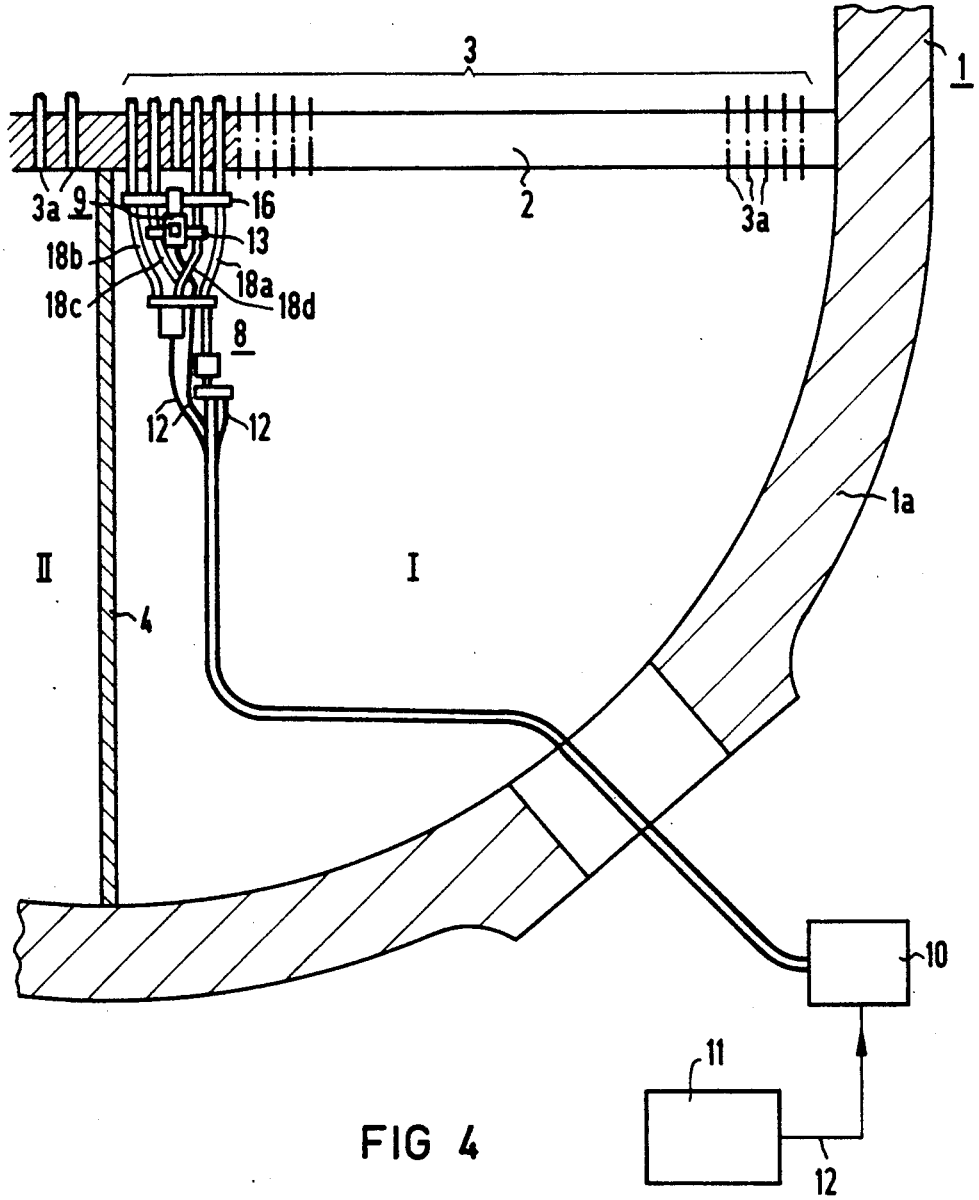

The construction and method of operation of the invention, however, together with additional objects and advantages thereof will be best understood from the following description of specific embodiments when read in connection with the accompanying drawings. FIGS. 1A and 1B are fragmentary, diagrammatic, longitudinal-sectional views of portions of an apparatus for positioning a tube sensor, the views being disposed as shown in a legend labelled FIG. 1 at the top of FIG. 1A;

FIGS. 2 and 3 are enlarged cross-sectional views of the apparatus taken along the lines II-II and III-III of FIGS. 1A and 1B, respectively, in the direction of the arrows; and FIG. 4 is a fragmentary sectional view of a heat exchanger having the manipulator anchored in a tube sheet or bottom.

Referring now to the figures of the drawing in detail and first, particularly, to FIG. 1 thereof, there is seen an apparatus for positioning a tube sensor, which is used to inspect or repair the tubes of a heat exchanger as shown in FIG. 4. As shown in FIG. 4, the heat exchanger for a nuclear power plant has a boiler wall 1 with a tube sheet or bottom 2 welded in place and a spherical bottom wall portion 1*a* for two primary chamber halves I, II. Discharging into the tube sheet 2 are orifices 3*a* at ends of a bundle or bank of heat exchanger tubes 3, only some of which are shown while others are indicated by broken lines. Primary medium flows through a non-illustrated primary loop line and through a non-illustrated inlet connector into the primary chamber half I, which is partitioned off from the primary chamber half II by a partition 4. The primary medium passes through the orifices 3*a* into the heat exchanger tubes 3, gives up its heat to secondary medium which is located in a secondary chamber and is intended to be heated there, flows through curved tube segments, such as in the shape of a U, to the second tube orifices 3*a* into the primary chamber half II, and leaves the primary chamber half II through non-illustrated outlet connectors.

The heat exchanger tubes 3 undergo repeated testing for defects (such as cracks) This is done with a tube sensor 5 shown in FIG. 1B that can be introduced into the tubes 3 and is, for instance, in the form of an eddy current measuring sensor. A cleaning tool for cleaning the tube from the inside or a repair tool for inserting plugs for sealing cracks can be used instead of an eddy current measuring sensor.

The tube sensor 5 is connected to a flexible supply hose 6, which at the same time serves as a displacement hose for the tube sensor. The tube sensor is movably guided inside a flexible guide hose 7 by means of the supply hose 6. The outside diameter of the supply hose 6 is smaller than the inside diameter of the guide hose 7. The guide hose 7 terminates in an adaptor 8, which is carried by a manipulator 9 as shown in FIG. 4. The supply hose 6 has a feeder device 10 at the end thereof facing away from the heat exchanger, and a control panel 11 is associated with this feeder device 10. The measuring instruments or control devices provided for testing and/or repair of the heat exchanger are disposed on the control panel or desk 11.

Supply and control cables 12 lead from the control panel 11 to the drive mechanism of the feeder device 10 and to the drive mechanisms of the manipulator 9 in the primary chamber half I of the heat exchanger.

As FIG. 1A shows, the manipulator 9 has a support body 16, which can be locked in the tube orifices 3*a* by means of two spreading mandrels 14, 15, as shown in FIG. 4. A further support body 13, which is drivable linearly and has two further spreading mandrels, is supported on the support body 16. While the support body 16 is locked by the spreading mandrels 14, 15, the other support body 13 can execute an incremental movement If the further spreading mandrels of the further support body 13 are locked at the tube orifices after an incremental movement has been executed, then the support body 16 executes an incremental movement In this way, each desired tube orifice 3*a* of the tube field can be reached with mouthpieces 17 disposed on the manipulator.

The mouthpieces 17 are disposed on the manipulator 9, and each mouthpiece communicates with a respective tube connector or guide hose 18*a*, 18*b*, 18*c* or 18*d*. One of the ends of each of the tube connectors 18*a*, 18*b*, 18*c*, 18*d* can be placed coaxially against a respective orifice 3*a* of the tubes of the heat exchanger. The other ends of the tube connectors 18*a*–18*d* are bundled into a circular group as shown in FIG. 2 and each discharge into one orifice of a fixed distributor plate 19. The guide hose 7 for the tube sensor 5 has been introduced into a parallel turntable 20 which is supported on the fixed distributor plate 19, as shown in FIG. 3. The support is effected centrally relative to the orifices in the distributor plate 19, in such a way that by incremental rotation of the turntable 20, the axis of the guide hose 7 introduced into the turntable is selectively aligned with the axis of an orifice in the distributor plate shown in FIG. 1B. In this way, the sensor 5 introduced into the guide hose 7 can be selectively introduced into one of the four tube orifices 3*a* without moving the manipulator 9. Naturally a greater number of tube connectors may also be provided, within the scope of the invention. The turntable 20 is supported by means of ball bearings 23 on a shaft 21, which is in the form of a screw bolt secured to the distributor plate by means of a nut 22. One end of the guide hose 7 terminates on a ring sensor 24 and the other end thereof is guided by a tube piece 25 through an opening in the turntable 20 and is provided with a mouthpiece that has a ring seal 26. In order to assure good penetration of the sensor, the transitions in the openings between the turntable 20 and the distributor plate 19 are widened conically. The ring sensor 24 serves to determine whether or not the sensor 5 is retracted whenever a change of mouthpiece is performed.

An electric drive motor 27 which is actuatable by remote control is mounted on the turntable 20, and a shaft 28 thereof is rotatably supported on the turntable and is connected to a disk 28*a*. As shown in FIG. 3, the disk 28*a* has a guide 28*e* and a driver pin 28*b*, which engages recesses 28*d* in a Maltese cross 28*c*. The Maltese cross 28*c* is firmly connected to the shaft 21, so that upon a rotational movement of the disk 28*a* provided with the pin 28*b* by 360°, the turntable 20 is rotated by 90° relative to the distributor plate 19. This incremental motion linkage of the Maltese cross which is known per se, thus carries out a rotational movement of the turntable 20 and four separate positions are possible. A positional indication is sent to the control panel 11 through cams and switches 28*f*.

The ring sensor 24 shown in FIG. 1B makes it possible to uncouple the guide hose 7 from the adaptor 8, which is connected through the tube connectors 18*a*–18*d* to the mouthpieces 17 that are secured on the support bodies 13 or 16 at a mutual spacing. The mutual spacing amounts to an integral multiple of the spacing between the heat exchanger tubes. The end of the cylindrical mouthpiece 17 facing toward the tube sheet has a ring seal 29 that is conically beveled on the inside. In order to attain a gentle pressing force, the mouthpiece 17 is elastically displaceably supported in a sheath 30, and is held in a given position by means of springs 31, 32 engaging the mouthpiece 17 and the sheath 30. The sheath 30 is retained on the manipulator 9. Both the guide hose 7 and the tube connectors 18*a*–18*d* are preferably made of a flexible material In order to introduce a medium into the guide hose 7 through the supply cable 12, an intermediate adaptor element 33 is provided, which has a tube piece 33*a* that has the same inside diameter as the guide hose 7.

We claim:

1. Apparatus for at least one of the inspection and repair of tubes discharging into a chamber of a heat exchanger, comprising a tube sensor to be positioned in a tube, a manipulator for the remote-controlled positioning of said tube sensor, a plurality of mouthpieces disposed on said manipulator for introducing said sensor into tubes of a heat exchanger, tube connectors communicating with said mouthpieces and having two ends, one of said ends of said tube connectors being coaxially attachable to orifices of the tubes of the heat exchanger, an adaptor at which the other of said ends of said tube connectors are bundled into a circular group, a distributor plate having orifices into each of which a respective one of said tube connectors discharge, a parallel turntable supported on said distributor plate, a guide hose introduced into said turntable for guiding said tube sensor, means for incrementally rotating said turntable for selectively aligning the axis of said guide hose with the axis of one of said orifices in said distributor plate, and means for translationally moving said manipulator.

2. Apparatus according to claim 1, wherein said adaptor is disposed in the vicinity of said manipulator.

3. Apparatus according to claim 1, wherein said rotating means include a drive motor and a Maltese cross incremental motion linkage connected between said drive motor and said turntable.

4. Apparatus according to claim 1, including a ring sensor through which said guide hose communicates with said adaptor.

5. Apparatus according to claim 1, including a supply cable, and an intermediate adaptor element connected between said supply cable and said guide hose for delivering medium into said guide hose, said intermediate adaptor element being disposed upstream of said adaptor as seen in direction of medium flow.

6. Apparatus according to claim 1, including sheaths releasably retained on said manipulator, said mouthpieces being displaceably supported in said sheaths, and springs holding said mouthpieces in a given position.

* * * * *